US012264880B2

(12) United States Patent
Onaka et al.

(10) Patent No.: US 12,264,880 B2
(45) Date of Patent: Apr. 1, 2025

(54) HEAT EXCHANGER, OUTDOOR UNIT INCLUDING HEAT EXCHANGER, AND AIR-CONDITIONING APPARATUS INCLUDING OUTDOOR UNIT

(71) Applicant: Mitsubishi Electric Corporation, Tokyo (JP)

(72) Inventors: Yoji Onaka, Tokyo (JP); Takashi Matsumoto, Tokyo (JP); Rihito Adachi, Tokyo (JP); Tetsuji Saikusa, Tokyo (JP); Yuki Nakao, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 264 days.

(21) Appl. No.: 17/919,157

(22) PCT Filed: May 22, 2020

(86) PCT No.: PCT/JP2020/020351
§ 371 (c)(1),
(2) Date: Oct. 14, 2022

(87) PCT Pub. No.: WO2021/234958
PCT Pub. Date: Nov. 25, 2021

(65) Prior Publication Data

US 2023/0168040 A1 Jun. 1, 2023

(51) Int. Cl.
*F28D 1/053* (2006.01)
*F25B 13/00* (2006.01)
(Continued)

(52) U.S. Cl.
CPC ..... *F28D 1/05391* (2013.01); *F25B 39/02* (2013.01); *F25B 39/04* (2013.01);
(Continued)

(58) Field of Classification Search
CPC ..... F25B 39/02; F25B 39/04; F25B 13/00; F28D 1/05391; F28D 1/0417;
(Continued)

(56) References Cited

U.S. PATENT DOCUMENTS 5,400,853 A * 3/1995 Wolters ..... F28D 1/05325 165/137
5,826,649 A 10/1998 Chapp et al.
(Continued)

FOREIGN PATENT DOCUMENTS

CA 2310360 A1 * 11/2000 ..... F28D 1/05366
DE 102015110845 A1 * 1/2016 ..... F25B 39/028
(Continued)

OTHER PUBLICATIONS

International Search Report of the International Searching Authority mailed Jul. 21, 2020 for the corresponding international application No. PCT/JP2020/020351 (and English translation).
(Continued)

*Primary Examiner* — Ljiljana V. Ciric
(74) *Attorney, Agent, or Firm* — Posz Law Group, PLC

(57) ABSTRACT

A heat exchanger includes: a heat exchange body having flat tubes arranged and spaced from each other in a horizontal direction; an upper header provided at an upper end of the heat exchange body; a lower header provided at a lower end of the heat exchange body; and a partition plate provided in at least one of the upper and lower headers to partition the heat exchange body into a plurality of regions in a horizontal direction. The partition plate is provided such that in each of the regions, refrigerant flows in the opposite direction to the flow direction of the refrigerant in an adjacent one of the region. The partition plate is also provided such that regarding the regions, the more downward the region relative to the flow of the refrigerant when the heat exchanger operates as
(Continued)

a condenser, the smaller the region's flow passage cross-sectional area.

10 Claims, 10 Drawing Sheets

(51) Int. Cl.

| | |
|---|---|
| ***F25B 39/02*** | (2006.01) |
| ***F25B 39/04*** | (2006.01) |
| ***F28D 1/02*** | (2006.01) |
| ***F28D 1/04*** | (2006.01) |
| ***F28D 21/00*** | (2006.01) |
| ***F28F 1/12*** | (2006.01) |
| ***F28F 9/02*** | (2006.01) |

(52) U.S. Cl.
CPC ..... *F28D 1/0417* (2013.01); *F28F 1/128* (2013.01); *F28F 9/0202* (2013.01); *F28F 9/0209* (2013.01); *F28F 9/0212* (2013.01); *F28F 9/0278* (2013.01); *F28F 9/028* (2013.01); *F25B 13/00* (2013.01); *F28D 2001/0273* (2013.01); *F28D 2001/028* (2013.01); *F28D 2021/0068* (2013.01); *F28D 2021/007* (2013.01); *F28D 2021/0084* (2013.01)

(58) Field of Classification Search
CPC ..... F28D 2001/0273; F28D 2001/028; F28D 2021/0068; F28D 2021/007; F28D 2021/0084; F28F 1/128; F28F 9/0202; F28F 9/0209; F28F 9/0212; F28F 9/0278; F28F 9/028
See application file for complete search history.

(56) References Cited

U.S. PATENT DOCUMENTS

| | | | | |
|---|---|---|---|---|
| 7,290,630 | B2 * | 11/2007 | Maeda | F28F 1/128 180/69.2 |
| 7,594,407 | B2 * | 9/2009 | Singh | F25B 49/005 62/149 |
| 7,596,959 | B2 * | 10/2009 | Singh | F04D 27/001 702/182 |
| 7,665,315 | B2 * | 2/2010 | Singh | F25B 49/005 62/125 |
| 7,752,854 | B2 * | 7/2010 | Singh | F25B 49/02 236/94 |
| 11,384,988 | B2 * | 7/2022 | Mieda | F28D 1/05391 |
| 11,506,402 | B2 * | 11/2022 | Matsui | F28D 1/0435 |
| 12,044,480 | B2 * | 7/2024 | Onaka | F28D 1/05383 |
| 2002/0023736 | A1 | 2/2002 | Inaba et al. | |
| 2003/0116308 | A1 | 6/2003 | Watanabe et al. | |
| 2012/0211228 | A1 * | 8/2012 | Troshko | E21B 43/124 166/305.1 |
| 2013/0240185 | A1 * | 9/2013 | Katoh | F28D 1/0426 165/140 |
| 2020/0325373 | A1 * | 10/2020 | Nishio | C09K 5/045 |
| 2021/0222893 | A1 | 7/2021 | Matsui et al. | |
| 2022/0196345 | A1 * | 6/2022 | Nakamura | F25B 39/022 |
| 2022/0381515 | A1 * | 12/2022 | Akaiwa | F28F 9/0265 |
| 2023/0168040 | A1 * | 6/2023 | Onaka | F28D 1/0417 165/173 |
| 2024/0085116 | A1 * | 3/2024 | Nakamura | F28F 9/0207 |

FOREIGN PATENT DOCUMENTS

| | | | | | |
|---|---|---|---|---|---|
| DE | 102015110845 | B4 | * | 9/2021 | F25B 39/028 |
| EP | 1058080 | A1 | * | 12/2000 | F28D 1/05366 |
| EP | 3742084 | A1 | * | 11/2020 | C09K 5/044 |
| EP | 3922941 | A1 | * | 12/2021 | F25B 39/00 |
| ES | 2711250 | T3 | * | 4/2019 | F25B 13/00 |
| JP | H05-1865 | A | | 1/1993 | |
| JP | H07-127988 | A | | 5/1995 | |
| JP | H10-185360 | A | | 7/1998 | |
| JP | 2000346568 | A | * | 12/2000 | F28D 1/05366 |
| JP | 2005-090806 | A | | 4/2005 | |
| JP | 2009-299963 | A | | 12/2009 | |
| JP | 2018-096638 | A | | 6/2018 | |
| JP | 6556385 | B1 | * | 8/2019 | C09K 5/044 |
| WO | 2019/239446 | A1 | | 12/2019 | |

OTHER PUBLICATIONS

Extended European Search Report dated May 23, 2023 issued in corresponding European patent application No. 20936983.4.
Office Action dated Jan. 15, 2025 issued in corresponding Chinese Patent Application No. 202080100901.1 (and English translation).

* cited by examiner

HEAT EXCHANGER, OUTDOOR UNIT INCLUDING HEAT EXCHANGER, AND AIR-CONDITIONING APPARATUS INCLUDING OUTDOOR UNIT

CROSS REFERENCE TO RELATED APPLICATION

This application is a U.S. national stage application of PCT/JP2020/020351 filed on May 22, 2020, the contents of which are incorporated herein by reference.

TECHNICAL FIELD

The present disclosure relates to a heat exchanger including a plurality of flat tubes, an outdoor unit including the heat exchanger, and an air-conditioning apparatus including the outdoor unit.

BACKGROUND ART

A given existing heat exchanger includes a plurality of flat tubes extending in a vertical direction and spaced from each other in a horizontal direction, a plurality of fins which are each connected between associated adjacent ones of the flat tubes and which transfer heat to the flat tubes, and headers provided at upper and lower ends of the flat tubes (see, for example, Japanese Unexamined Patent Application Publication No. 2018-96638.)

The heat exchanger of Japanese Unexamined Patent Application Publication No. 2018-96638 is provided in an outdoor unit of an air-conditioning apparatus that is capable of both cooling operation and heating operation. In the case where the heating operation is performed in a low-temperature environment in which an outdoor air temperature is low and the surface temperature of the heat exchanger is lower than or equal to 0 degrees C., frost forms on the heat exchanger. Thus, when the amount of the frost that forms on the heat exchanger reaches a certain amount or more, a defrosting operation of causing the frost on a surface of the heat exchanger to melt is performed. In the defrosting operation, high-temperature and high-pressure gas refrigerant is caused to flow into the flat tubes though one of the headers, to thereby remove the frost.

SUMMARY OF INVENTION

Technical Problem

In such an existing heat exchanger as described in Patent Literature 1, in the defrosting operation, as refrigerant that has flowed into the flat tubes from a header flows farther, the refrigerant is further cooled, and the more downward the flowing refrigerant, the higher the ratio of the liquid phase of the refrigerant. Then, the higher the ratio of liquid phase of the refrigerant, the lower the velocity of the refrigerant, as a result of which the refrigerant more easily flows backward. If the refrigerant flows backward, the defrosting performance is deteriorated.

The present disclosure is applied to solve the above problem, and relates to a heat exchanger that reduces the probability with which refrigerant will flow backward, an outdoor unit including the heat exchanger, and an air-conditioning apparatus including the outdoor unit.

Solution to Problem

A heat exchanger includes: a heat exchange body having a plurality of flat tubes arranged and spaced from each other in a horizontal direction; an upper header provided at an upper end of the heat exchange body; a lower header provided at a lower end of the heat exchange body; and a partition plate provided in at least one of the upper and lower headers to partition the heat exchange body into a plurality of regions in a horizontal direction. The partition plate is provided such that in each of the regions, refrigerant flows in the opposite direction to the flow direction of the refrigerant in an adjacent one of the regions, and is provided such that regarding the regions, the more downward the region in the flow of the refrigerant when the heat exchanger operates as a condenser, the smaller a flow passage cross-sectional area of the region.

Furthermore, an outdoor unit of an air-conditioning apparatus according to another embodiment of the present disclosure includes the heat exchanger described above.

Furthermore, an air-conditioning apparatus according to still another embodiment of the present disclosure includes the outdoor unit described above.

Advantageous Effects of Invention

In the heat exchanger according to the embodiment of the present disclosure, the outdoor unit including the heat exchanger, and the air-conditioning apparatus including the outdoor unit, the partition plate is provided such that in each of the regions of the heat exchange body, refrigerant flows in the opposite direction to the flow direction of refrigerant in an adjacent one of the regions, and is provided such that regarding the regions of the heat exchange body, the more downstream a region in the flow of refrigerant in the case where the heat exchanger operates as a condenser, the smaller the flow passage cross-sectional area of the region. In such a manner, since regarding the regions, the more downstream a region in the flow of refrigerant in the case where the heat exchanger operates as a condenser, the smaller the flow passage cross-sectional area of the region, it is possible to reduce lowering of the flow velocity of the refrigerant, even when the ratio of the liquid phase of the refrigerant becomes higher, and thus reduce the probability that backflow of the refrigerant will occur.

DESCRIPTION OF EMBODIMENTS

The embodiments of the present disclosure will be described with reference to the drawings. This description, however, is not limiting. Furthermore, in each of references which will be referred to below, relationships in size between components may be different from actual ones.

Embodiment 1

<Configuration of Air-conditioning Apparatus 100>

Figure 1:
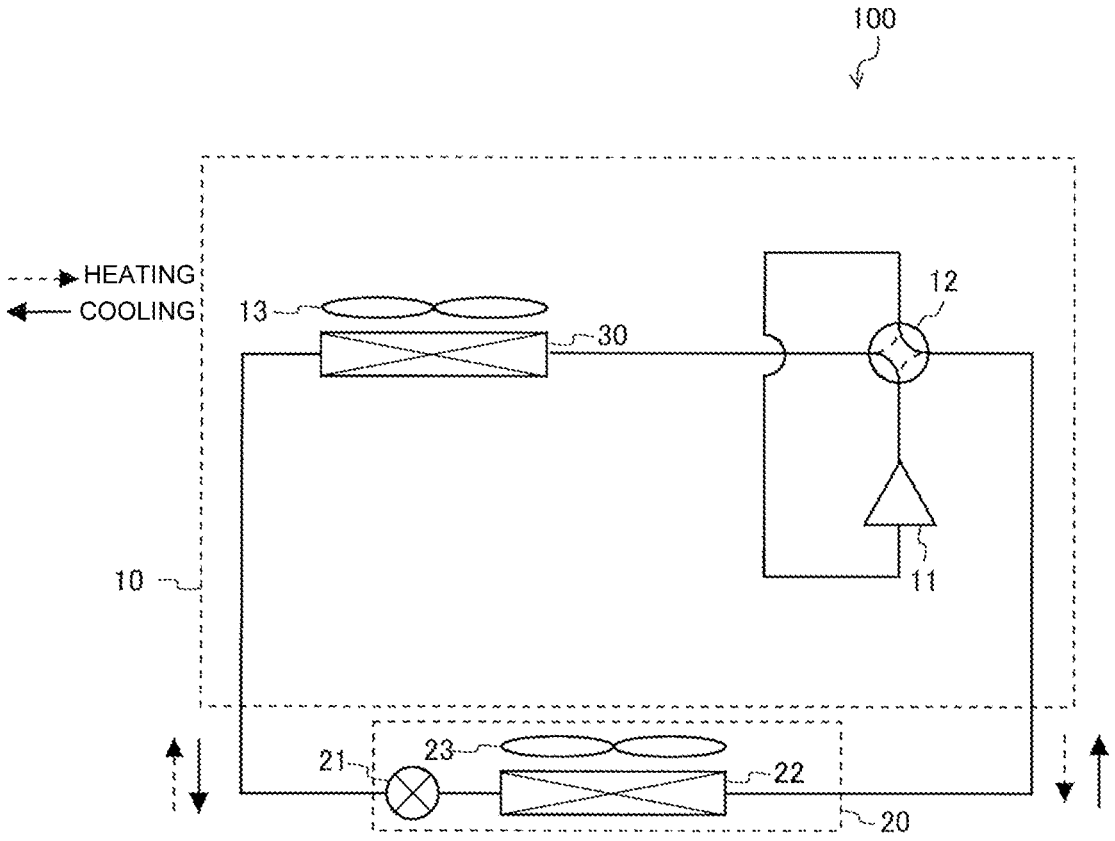
FIG. 1 is a refrigerant circuit diagram of an air-conditioning apparatus including a heat exchanger according to Embodiment 1.

FIG. 1 is a refrigerant circuit diagram of an air-conditioning apparatus 100 including a heat exchanger 30 according to Embodiment 1. In FIG. 1, solid arrows indicate the flow of refrigerant during cooling operation, and dashed arrows indicate the flow of refrigerant during heating operation.

As illustrated in FIG. 1, the heat exchanger 30 according to Embodiment 1 is provided in an outdoor unit 10 of an air-conditioning apparatus 100 that includes the outdoor unit 10 and an indoor unit 20. The outdoor unit 10 includes a compressor 11, a flow switching device 12, and a fan 13 in addition to the heat exchanger 30. The indoor unit 20 includes an expansion device 21, an indoor heat exchanger 22, and an indoor fan 23.

The air-conditioning apparatus 100 includes a refrigerant circuit in which the compressor 11, the flow switching device 12, the heat exchanger 30, the expansion device 21, and the indoor heat exchanger 22 are connected by refrigerant pipes and refrigerant is circulated. The air-conditioning apparatus 100 is capable of performing both the cooling operation and the heating operation. The operation of the air-conditioning apparatus 100 is switched to one of the cooling operation and the heating operation by a switching operation of the flow switching device 12.

The compressor 11 sucks low-temperature and low-pressure refrigerant, compresses the sucked refrigerant to change it into high-temperature and high-pressure refrigerant, and discharges the high-temperature and high-pressure refrigerant. The compressor 11 is, for example, an inverter compressor whose capacity is the rate of delivery per unit time and is controlled by varying an operating frequency.

The flow switching device 12 is, for example, a four-way valve, and performs switching between the cooling operation and the heating operation by switching the flow direction of refrigerant. In order that the cooling operation be performed, the state of the flow switching device 12 is switched to a state indicated by solid lines in FIG. 1, whereby a discharge side of the compressor 11 is connected to the heat exchanger 30. In contrast, in order that the heating operation be performed, the state of the flow switching device 12 is switched to a state indicated by dashed lines in FIG. 1, whereby the discharge side of the compressor 11 is connected to the indoor heat exchanger 22.

The heat exchanger 30 causes heat exchange to be performed between outdoor air and refrigerant. In the cooling operation, the heat exchanger 30 operates as a condenser that condenses the refrigerant by causing the refrigerant to transfer heat to the outdoor air. Furthermore, in the heating operation, the heat exchanger 30 operates as an evaporator that evaporates the refrigerant and cool the outdoor air with the heat of vaporization which is required for evaporation of the refrigerant.

The fan 13 supplies outdoor air to the heat exchanger 30. The amount of air that is sent from the fan 13 to the heat exchanger 30 is adjusted under a control of the rotation speed of the fan 13.

The expansion device 21 is, for example, an electronic expansion valve whose opening degree can be adjusted. The opening degree of the expansion device 21 is adjusted, thereby controlling the pressure of refrigerant that flows into the heat exchanger 30 or the indoor heat exchanger 22. In Embodiment 1, the expansion device 21 is provided in the indoor unit 20; however, the expansion device 21 may be provided in the outdoor unit 10. The place of installation of the expansion device 21 is not limited.

The indoor heat exchanger 22 causes heat exchange to be performed between indoor air and refrigerant. In the cooling operation, the indoor heat exchanger 22 operates as an evaporator that evaporates the refrigerant and cool the indoor air with the heat of vaporization that is required for evaporation of the refrigerant. In the heating operation, the indoor heat exchanger 22 operates as a condenser that causes the heat of the refrigerant to be transferred to the indoor air, thereby condensing the refrigerant.

The indoor fan 23 supplies indoor air to the indoor heat exchanger 22. The amount of air that is sent from the indoor fan 23 to the indoor heat exchanger 22 is adjusted under a control of the rotation speed of the indoor fan 23.

<Configuration of Heat Exchanger 30>

Figure 2:
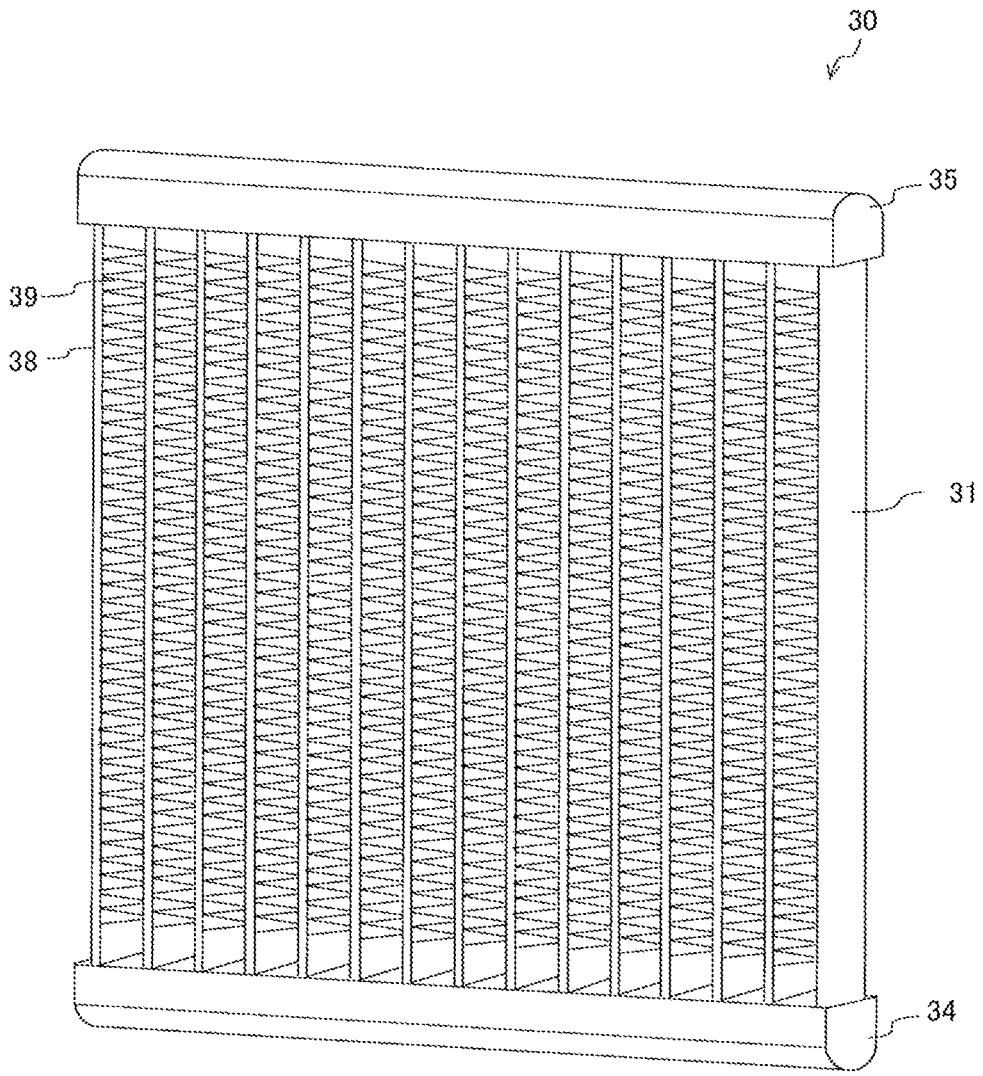
FIG. 2 is a perspective view of the heat exchanger according to Embodiment 1.

FIG. 2 is a perspective view of the heat exchanger 30 according to Embodiment 1.

As illustrated in FIG. 2, the heat exchanger 30 includes a heat exchange body 31 including a plurality of flat tubes 38 and a plurality of fins 39. The flat tubes 38 are arranged and spaced from each other in parallel in a horizontal direction, thereby enabling a wind generated by the fan 13 to flow, and the flat tubes 38 also extend in a vertical direction to allow refrigerant to flow in the vertical direction in the flat tubes 38. The fins 39 are each connected between associated adjacent ones of the flat tubes 38, and transfer heat to these flat tubes 38. It should be noted that the fins 39 are provided to improve the efficiency of heat exchange between air and refrigerant. For example, corrugated fins are used as the fins 39; however, the fins 39 are not limited to the corrugated fins. The fins 39 may be omitted, since air and refrigerant exchange heat with each other at surfaces of the flat tubes 38.

At a lower end of the heat exchange body 31, a lower header 34 is provided. In the lower header 34, lower ends of the flat tubes 38 of the heat exchange body 31 are directly inserted. Furthermore, at an upper end of the heat exchange body 31, an upper header 35 is provided. In the upper header 35, upper ends of the flat tubes 38 of the heat exchange body 31 are directly inserted.

The lower header 34 is connected to the refrigerant circuit of the air-conditioning apparatus 100 via a gas pipe 37 (see FIG. 3, which will be referred later), and will also be referred to as "gas header". In the cooling operation, the lower header 34 causes high-temperature and high-pressure gas refrigerant from the compressor 11 to flow into the heat exchanger 30, and in the heating operation, causes low-temperature and low-pressure gas refrigerant subjected to heat exchange at the heat exchanger 30 to flow out therefrom to the refrigerant circuit.

The upper header 35 is connected to the refrigerant circuit of the air-conditioning apparatus 100 via a liquid pipe 36 (see FIG. 3), and will also be referred to as "liquid header". In the heating operation, the upper header 35 causes low-temperature and low-pressure two-phase refrigerant to flow into the heat exchanger 30, and in the cooling operation, causes low-temperature and high-pressure liquid refrigerant subjected to heat exchange at the heat exchanger 30 to flow out therefrom to the refrigerant circuit.

The flat tubes 38, the fins 39, the lower header 34, and the upper header 35 are all made of aluminum, and are joined together by brazing.

<Cooling Operation>

High-temperature and high-pressure gas refrigerant discharged from the compressor 11 flows into the heat exchanger 30 via the flow switching device 12. After having flowed into the heat exchanger 30, the high-temperature and high-pressure gas refrigerant condenses while transferring heat to outdoor air taken in by the fan 13, in heat exchange with the outdoor air, and as a result, changes into low-temperature and high-pressure liquid refrigerant, which then flows out of the heat exchanger 30. After having flowed out of the heat exchanger 30, the low-temperature and high-pressure liquid refrigerant is decompressed by the expansion device 21 to change into low-temperature and low-pressure two-phase gas-liquid refrigerant, and the low-temperature and low-pressure two-phase gas-liquid refrigerant then flows into the indoor heat exchanger 22. After having flowed into the indoor heat exchanger 22, the low-temperature and low-pressure two-phase gas-liquid refrigerant evaporates while receiving heat from indoor air taken in by the indoor fan 23, in heat exchange with the indoor air, and also cooling the indoor air, and as a result, changes into low-temperature and low-pressure gas refrigerant, and the low-temperature and low-pressure gas refrigerant then flows out of the indoor heat exchanger 22. After having flowed out of the indoor heat exchanger 22, the low-temperature and low-pressure gas refrigerant is sucked into the compressor 11 to change back into high-temperature and high-pressure gas refrigerant.

<Heating Operation>

High-temperature and high-pressure gas refrigerant discharged from the compressor 11 flows into the indoor heat exchanger 22 via the flow switching device 12. After having flowed into the indoor heat exchanger 22, the high-temperature and high-pressure gas refrigerant condenses while transferring heat to indoor air taken in by the indoor fan 23, in heat exchange with the indoor air, and thus heating the indoor air, and as a result, changes into low-temperature and high-pressure liquid refrigerant, and the low-temperature and high-pressure liquid refrigerant then flows out of the indoor heat exchanger 22. After having flowed out of the indoor heat exchanger 22, the low-temperature and high-pressure liquid refrigerant is decompressed by the expansion device 21 to change into low-temperature and low-pressure two-phase gas-liquid refrigerant, and the low-temperature and low-pressure two-phase gas-liquid refrigerant then flows into the heat exchanger 30. After having flowed into the heat exchanger 30, the low-temperature and low-pressure two-phase gas-liquid refrigerant evaporates while receiving heat from outdoor air taken in by the fan 13, in heat exchange with the outdoor air, and as a result, changes into low-temperature and low-pressure gas refrigerant, and the low-temperature and low-pressure gas refrigerant flows out of the heat exchanger 30. After having flowed out of the heat exchanger 30, the low-temperature and low-pressure gas refrigerant is sucked into the compressor 11 to change back into high-temperature and high-pressure gas refrigerant.

<Defrosting Operation>

In the case where the heating operation is performed in a low-temperature environment in which the surface temperatures of the flat tubes 38 and the fins 39 drop to 0 degrees C. or less, frost forms on the heat exchanger 30. When the amount of frost that forms on the heat exchanger 30 reaches a given amount or more, an air passage at the heat exchanger 30 through which a wind from the fan 13 passes is closed by the frost, as a result of which the performance of the heat exchanger 30 is deteriorated and a heating performance is also deteriorated. Thus, in the case where the heating performance is deteriorated, a defrosting operation of causing the frost on a surface of the heat exchanger 30 to melt is performed.

In the defrosting operation, the fan 13 is stopped, and the state of the flow switching device 12 is switched to the same state as in the cooling operation, whereby high-temperature and high-pressure gas refrigerant flows into the heat exchanger 30. As a result, the frost adhering to the flat tubes 38 and the fins 39 melt. When the defrosting operation is started, the high-temperature and high-pressure gas refrigerant flows into each of the flat tubes 38 via the lower header 34. Then, the high-temperature refrigerant that has flowed into the flat tubes 38 causes the frost adhering to the flat tubes 38 and the fins 39 to melt and change into water. The water into which the frost melts and changes (hereinafter referred to as "defrost water") drains from and along the flat tubes 38 or the fins 39 toward a region located below the heat exchanger 30. When the adhering frost melts, the defrosting operation is ended, and the heating operation is resumed.

In the defrosting operation, refrigerant that has flowed from the lower header 34 is further cooled as it flows through the flat tubes 38, such that the more downstream the flowing refrigerant, the higher the ratio of the liquid phase of the refrigerant. The higher the ratio of the liquid-phase of the refrigerant, the lower the velocity of the refrigerant, as a result of which the refrigerant more easily flows backward. In the related art, when the refrigerant flows backward, the defrosting performance is deteriorated.

Figure 3:
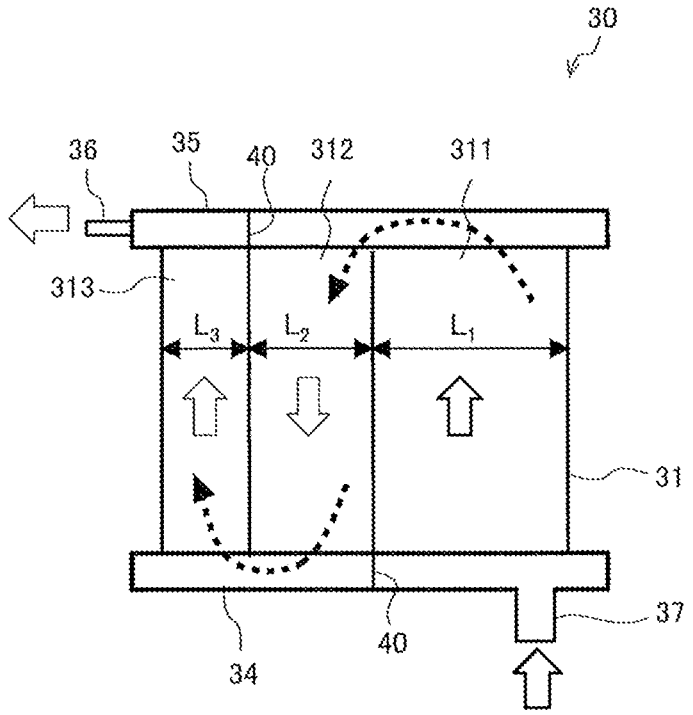
FIG. 3 is a front view schematically illustrating a defrosting-operation refrigerant flow at the heat exchanger according to Embodiment 1.

FIG. 3 is a front view schematically illustrating the flow of refrigerant in the defrosting operation at the heat exchanger 30 according to Embodiment 1. In FIG. 3, outlined arrows and black dashed arrows all indicate flows of refrigerant.

In the heat exchanger 30 according to Embodiment 1, in the lower header 34 and the upper header 35, respective partition plates 40 are provided as illustrated in FIG. 3. The partition plates 40 are provided to partition the heat exchange body 31 into a plurality of regions in the horizontal direction. Furthermore, the partition plates 40 are provided such that refrigerant in each of the regions of the heat exchange body 31 flows in the opposite direction to the flow direction of refrigerant in an adjacent one of the regions that is adjacent to the above region, and is provided such that regarding the regions of the heat exchange body 31, the more downstream the region in the flow of refrigerant in the case where the heat exchanger 30 operates as a condenser (the flow of refrigerant being hereinafter referred to as "defrosting-operation refrigerant flow"), the smaller the flow passage cross-sectional area of the region.

In Embodiment 1, at each of the lower header 34 and the upper header 35, a single partition plate 40 is provided. That is, the total number of the partition plates 40 is two. It should be noted that the number of the partition plates 40 is not limited to 2, but may be 1 or may be larger than or equal to 3. Furthermore, the heat exchange body 31 is partitioned by the partition plates 40 into three regions, that is, a first region 311, a second region 312, and a third region 313. In the flow of refrigerant in the defrosting operation, that is, the defrosting-operation refrigerant flow, the first region 311 is located most upstream, and the third region 313 is located most downstream.

Moreover, as illustrated in FIG. 3, in the first and third regions 311 and 313 of the heat exchange body 31, the refrigerant flows upward in the vertical direction, that is, the flow of the refrigerant is an upward flow, and in the second region 312 of the heat exchange body 31, the refrigerant flows downward in the vertical direction, that is, the flow of the refrigerant is a downward flow. Therefore, each of the regions of the heat exchange body 31 is provided such that in the region, refrigerant flows in the opposite direction to the flow direction of refrigerant that flows in the adjacent region. It should be noted that as indicated by arrows in FIG. 3, the refrigerant flows through components and regions in the following order: the gas pipe 37, the lower header 34, the first region 311 of the heat exchange body 31, the upper header 35, the second region 312 of the heat exchange body 31, the lower header 34, the third region 313 of the heat exchange body 31, the upper header 35, and the liquid pipe 36.

Furthermore, L1>L2>L3, where L1, L2, and L3 are the lengths of the first, second, and third regions 311, 312 and 313 of the heat exchange body 31 in the horizontal direction, respectively. Therefore, the first region 311 of the heat exchange body 31 has the largest flow passage cross-sectional area, and a largest number of flat tubes 38 are provided in the first region 311. The third region 313 of the heat exchange body 31 has the smallest flow passage cross-sectional area, and a smallest number of flat tubes 38 are provided. That is, in the regions of the heat exchange body 31, the more downstream the region in the defrosting-operation refrigerant flow, the smaller the flow passage cross-sectional area of the region.

In such a manner, in Embodiment 1, a region located downstream in the defrosting-operation refrigerant flow is made to have a smaller flow passage cross-sectional area than a region located upstream in the defrosting-operation refrigerant flow, on the premise that in these regions, the refrigerant flows at the same flow rate, whereby the velocity of the refrigerant in the above region located downstream is higher than that in the above region located upstream. Therefore, even in the case where the more downstream the region, the higher the ratio of the liquid phase of the refrigerant in the region, it is possible to reduce the possibility with which back-flow of the refrigerant will occur, and also reduce deterioration of the defrosting performance that would be caused by the back-flow of the refrigerant.

Furthermore, the heat exchanger 30 is configured such that in the case where the refrigerant flows upward in a region of the heat exchange body 31 that is located most downward when the heat exchanger 30 operates as a condenser, the flow of the refrigerant in the above region which is located most downstream and in which the refrigerant flows upward (which will be hereinafter referred to as "region Z") has a flooding constant C greater than 1. The flooding constant C is defined based on the flow rate of refrigerant that flows into the region Z in an intermediate load capacity (50% capacity) operation when the heat exchanger 30 operates as a condenser.

For example, according to a well-known Wallis formula, the flooding constant C is expressed by $C=J_G^{0.5}+J_L^{0.5}$.

$J_G$ is a dimensionless gas apparent velocity, and $J_L$ is a dimensionless liquid apparent velocity. $J_G$ and $J_L$ are expressed by the following equations:

$$J_G=U_G\times\{\rho G/[9.81\times D_{eq}(\rho L-\rho G)]\}^{0.5}$$

$$J_L=U_L\times\{\rho L/[9.81\times D_{eq}(\rho L-\rho G)]\}^{0.5}$$

Figure 4:
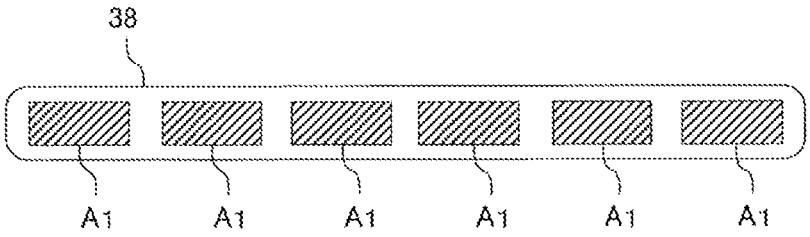
FIG. 4 is a diagram illustrating the flow passage cross-sectional area of a flat tube of the heat exchanger according to Embodiment 1.

FIG. 4 is a diagram illustrating the flow passage cross-sectional area of a flat tube 38 of the heat exchanger 30 according to Embodiment 1.

$D_{eq}$ is an equivalent diameter [m] that is defined by the number N of flat tubes 38 disposed in the region Z and the flow passage cross-sectional areas $A_1$ (the total area of hatched areas as illustrated in FIG. 4), and is calculated as $D_{eq}=[(4\times A_{eq})/3.14]^{0.5}$. It should be noted that $A_{eq}$ is calculated as $A_{eq}=A_1\times N$.

ρL is the liquid density [kg/m$^3$] of refrigerant, ρG is the gas density [kg/m$^3$] of refrigerant, and ρL and ρG are each a state quantity that can be calculated according to the kind and pressure of refrigerant that flows into the heat exchanger 30.

$U_G$ is the gas apparent velocity [m/s], and $U_L$ is the liquid apparent velocity [m/s]. $U_G$ is calculated as $U_G=(G\times x)/\rho G$, and $U_L$ is calculated as $U_L=[G\times(1-x)]/\rho L$.

G is calculated as $G=M/A_{eq}$, where G is the maximum velocity of flow [kg/m$^2$s] of high-temperature and high-pressure gas refrigerant that flows into the heat exchanger 30, and M is the maximum quantity of flow [kg/s] of the high-temperature and high-pressure gas refrigerant that flows into the heat exchanger 30.

x is the quality of the refrigerant that flows into the region Z, and can be calculated, for example, based on the amount or performance of heat exchange at the heat exchanger 30. For example, assuming that the quality of the refrigerant varies from 1 to 0 between an inlet and an outlet of the heat exchanger 30, and the amount of heat exchange ∝ the heat transfer area, x can be estimated by the ratio of the number of flat tubes 38 disposed in a region situated upstream of the region Z to the total number of flat tubes 38 of the heat exchanger 30. For example, in Embodiment 1, x can be defined as x=1−(the number of flat tubes in the first region+the number of flat tubes in the second region)/(the number of flat tubes in the first region+the number of flat tubes in the second region+the number of flat tubes in the third region).

As described above, the heat exchanger 30 is configured such that in the case where the refrigerant flows upward through a region of the heat exchange body 31 that is located most downward, when the heat exchanger 30 operates as a condenser, the flow of the refrigerant in the region Z of the heat exchange body 31 has a flooding constant C greater than 1. It is therefore possible to more reliably reduce the probability that backflow of the refrigerant will occur, even in the case where the refrigerant flows upward through the region of the heat exchange body 31 that is located most downward when the heat exchanger 30 operates as a condenser.

As described above, the heat exchanger 30 according to Embodiment 1 includes the heat exchange body 31 including the flat tubes 38 spaced from each other in the horizontal direction, the upper header 35 provided at the upper end of the heat exchange body 31, the lower header 34 provided at the lower end of the heat exchange body 31, and the partition plate 40 provided in at least one of the upper header 35 and the lower header 34 to partition the heat exchange body 31 into a plurality of regions in the horizontal direction. The partition plate 40 is provided to partition off the regions such that in each of the regions, refrigerant flows in the opposite direction to the flow direction of refrigerant in one of the regions that is adjacent to the above region, and also provided such that regarding the regions, the more downstream the region in the flow direction of the refrigerant in the case where the heat exchanger 30 operates as a condenser, the smaller the flow passage cross-sectional area of the region.

In the heat exchanger 30 according to Embodiment 1, the partition plate 40 is provided to partition the heat exchange body 31 into the regions such that in each of the regions, refrigerant flows in the opposite direction to the flow direction of refrigerant in the adjacent region, and also provided such that regarding the regions, the more downstream the region in the flow direction of the refrigerant in the case where the heat exchanger 30 operates as a condenser, the smaller the flow passage cross-sectional flow direction of the refrigerant in the case where the heat exchanger 30 operates as a condenser, the smaller the flow passage cross-sectional area of the region, it is possible to reduce lowering of the flow velocity of the refrigerant even when the ratio of the liquid phase of the refrigerant becomes higher, and is thus also possible to reduce the probability that backflow of the refrigerant will occur.

Furthermore, the outdoor unit 10 according to Embodiment 1 includes the above heat exchanger 30. The outdoor unit 10 according to Embodiment 1 can obtain similar advantages to those of the heat exchanger 30.

Moreover, the air-conditioning apparatus 100 according to Embodiment 1 includes the above outdoor unit 10. The air-conditioning apparatus 100 according to Embodiment 1 can obtain similar advantages to those of the outdoor unit 10.

Embodiment 2

Regarding Embodiment 2, components that are the same as or equivalent to those in Embodiment 1 will be denoted by the same reference signs, and configurations, etc., that are the same as those in Embodiment 1 and have already been described regarding Embodiment 1 will not be re-described.

Figure 5:
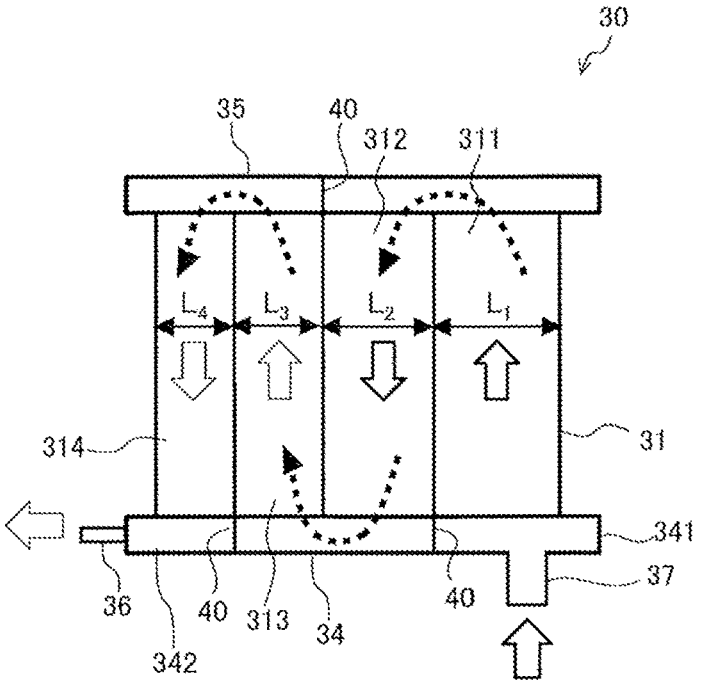
FIG. 5 is a front view schematically illustrating the defrosting-operation refrigerant flow at a heat exchanger according to Embodiment 2.

FIG. 5 is a front view schematically illustrating the flow of refrigerant in the heat exchanger 30 according to Embodiment 2 in the defrosting operation. In FIG. 5, outlined arrows and dashed arrows all indicate the flow of refrigerant.

In the heat exchanger 30 according to Embodiment 2, as illustrated in FIG. 5, two partition plates 40 are provided in the lower header 34, and a single partition plate 40 is provided in the upper header 35. That is, a three partition plates 40 are provided in total. Furthermore, the heat exchange body 31 is partitioned by the partition plates 40 into four regions, that is, a first region 311, a second region 312, a third region 313, and a fourth region 314. However, the number of partition plates 40 is not limited to 3, but may be an odd number larger than or equal to 5.

A portion of the lower header 34 which is located most upstream in the defrosting-operation refrigerant flow and which will be hereinafter referred to as "first portion 341" is connected to the refrigerant circuit of the air-conditioning apparatus 100 by the gas pipe 37. The first portion 341 of the lower header 34 causes, in the cooling operation, high-temperature and high-pressure gas refrigerant from the compressor 11 to flow into the heat exchanger 30, and causes, in the heating operation, low-temperature and low-pressure gas refrigerant subjected to heat exchange at the heat exchanger 30 to flow out therefrom to the refrigerant circuit.

A portion of the lower header 34 which is located most downstream in the defrosting-operation refrigerant flow and which will be hereinafter referred to as "second portion 342" is connected to the refrigerant circuit of the air-conditioning apparatus 100 by the liquid pipe 36. The second portion 342 of the lower header 34 causes, in the heating operation, low-temperature and low-pressure two-phase refrigerant to flow into the heat exchanger 30 in the heating operation, and causes, in the cooling operation, low-temperature and high-pressure liquid refrigerant subjected to heat exchange at the heat exchanger 30 to flow out therefrom to the refrigerant circuit.

Furthermore, as illustrated in FIG. 5, in the first and third regions 311 and 313 of the heat exchange body 31, the refrigerant flows upward, that is, the flow of the refrigerant is the upward flow, and in the second and fourth regions 312 and 314 of the heat exchange body 31, the refrigerant flows downward, that is, the flow of the refrigerant is the downward flow. Therefore, each of the regions of the heat exchange body 31 is provided such that in the region, refrigerant flows in the opposite direction to that in one of the regions that is adjacent to the above region. It should be noted that in the defrosting operation, as indicated by arrows in FIG. 5, the refrigerant flows through components and regions in the following order: the gas pipe 37, the lower header 34, the first region 311 of the heat exchange body 31, the upper header 35, the second region 312 of the heat exchange body 31, the lower header 34, the third region 313 of the heat exchange body 31, the upper header 35, the fourth region 314 of the heat exchange body 31, the lower header 34, and then the liquid pipe 36.

Furthermore, $L1>L2>L3>L4$, where $L1$, $L2$, $L3$, and $L4$ are the lengths of the first region 311, the second region 312, the third region 313, and the fourth region 314 of the heat exchange body 31 in the horizontal direction, respectively. Therefore, of these regions, in the first region 311 of the heat exchange body 31, the number of flat tubes 38 provided is the largest, and the first region has the largest flow passage cross-sectional area; and in the fourth region 314 of the heat exchange body 31, the number of flat tubes 38 provided is the smallest, and the fourth region 314 has the smallest flow passage cross-sectional area. That is, regarding the regions of the heat exchange body 31, in the defrosting-operation refrigerant flow, the more downstream the region, the smaller the flow passage cross-sectional area of the region.

In such a manner, the flow of the refrigerant in the fourth region 314 which is the most downward one of the regions of the heat exchange body 31 in the defrosting-operation refrigerant flow is the downward flow, whereby it is possible to reduce the probability with which backflow will occur, even in the case where the more downward the refrigerant, the higher the ratio of the liquid phase of the refrigerant. Furthermore, since a region located downstream has a smaller flow passage cross-sectional area than a region situated upstream, on the premise that in these regions, the refrigerant flows at the same flow rate, the flow velocity of refrigerant in the region situated downstream is higher than that in the region situated upstream. It is therefore possible to further reduce the probability with which backflow will occur, even in the case where the more downward the flowing refrigerant, the higher the ratio of the liquid phase of the refrigerant, and further reduce deterioration of the defrosting performance which would be caused by backflow of the refrigerant.

As described above, in the heat exchanger 30 according to Embodiment 2, when the heat exchanger 30 operates as a condenser, the flow of refrigerant that flows in the most downward region is the downward flow.

In the heat exchanger 30 according to Embodiment 2, when the heat exchanger 30 operates as a condenser, refrigerant that flows in the most downward region flows downward, whereby it is possible to reduce the probability with which backflow will occur, even in the case where the more downward the flowing refrigerant, the higher the ratio of the liquid phase of the refrigerant.

Furthermore, the outdoor unit 10 according to Embodiment 2 includes the above heat exchanger 30. The outdoor unit 10 according to Embodiment 2 can obtain similar advantages to those of the heat exchanger 30.

Moreover, the air-conditioning apparatus 100 according to Embodiment 2 includes the above outdoor unit 10. The air-conditioning apparatus 100 according to Embodiment 2 can obtain similar advantages to those of the above outdoor unit 10.

Embodiment 3

Regarding Embodiment 3, components that are the same as or equivalent to those in Embodiment 2 will be denoted by the same reference signs, and configurations, etc., that are the same as those in Embodiment 2 and have already been described regarding Embodiment 2 will not be re-described.

Figure 6:
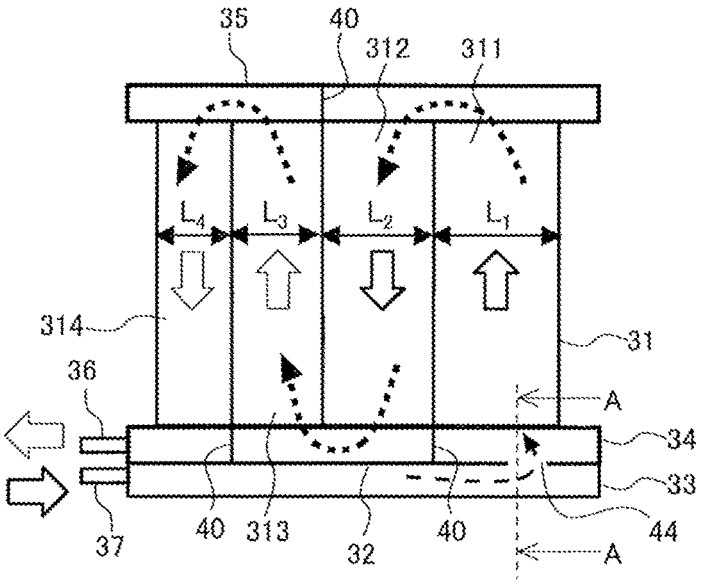
FIG. 6 is a front view schematically illustrating the defrosting-operation refrigerant flow at a heat exchanger according to Embodiment 3.
Figure 7:
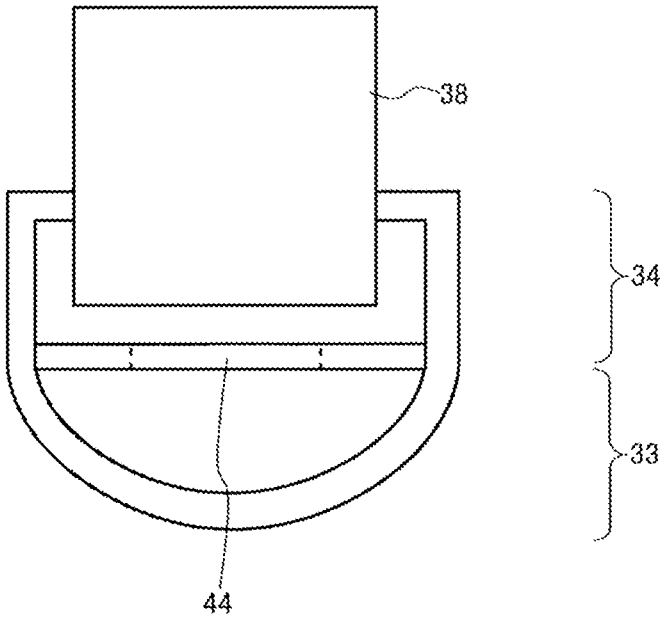
FIG. 7 is a cross-sectional view of the heat exchanger that is taken along line A-A in FIG. 6.

FIG. 6 is a front view schematically illustrating the defrosting-operation refrigerant flow at a heat exchanger 30 according to Embodiment 3. FIG. 7 is a cross-sectional view of the heat exchanger 30 that is taken along line A-A in FIG. 6. In FIG. 6, outlined arrows and dashed arrows all indicate the flow of refrigerant.

As illustrated in FIGS. 6 and 7, the heat exchanger 30 according to Embodiment 3 further includes an extension pipe 33 that extends in a longitudinal direction of the lower header 34.

At least part of the extension pipe 33 is in contact with the lower header 34. Furthermore, the extension pipe 33 is provided below the lower header 34. The lower header 34 is connected to the liquid pipe 36, and the extension pipe 33 is connected to the gas pipe 37. Furthermore, an opening port 44 is formed at a contact position between the extension pipe 33 and the lower header 34, whereby the extension pipe 33 and the lower header 34 communicate with each other. This opening port 44 is formed below the first region 311 of the heat exchange body 31.

In the defrosting operation, as indicated by arrows in FIG. 6, the refrigerant flows through components and regions in the following order: the gas pipe 37, the extension pipe 33, the lower header 34, the first region 311 of the heat exchange body 31, the upper header 35, the second region 312 of the heat exchange body 31, the lower header 34, the third region 313 of the heat exchange body 31, the upper header 35, the fourth region 314 of the heat exchange body 31, the lower header 34, and then the liquid pipe 36.

In Embodiment 3, the extension pipe 33 is provided to extend in parallel with the lower header 34, and is at least partly in contact with the lower header 34.

Furthermore, the extension pipe 33 is provided under the lower header 34. In such a manner, since the extension pipe 33 is at least partly in contact with the lower header 34, when high-temperature and high-pressure gas refrigerant flows through the extension pipe 33 in the defrosting operation, heat can be transferred from the extension pipe 33 to the lower header 34. Then, the heat transferred to the lower header 34 is further transferred to defrost water in the vicinity of the lower header 34, thereby raising the temperature of the defrost water. Therefore, even when the heating operation is resumed after the defrosting operation ends, it is possible to reduce the probability with which the defrost water in the vicinity of the lower header 34 will re-freeze. As a result, it is possible to reduce deterioration of a heating performance and damage to the heat exchanger 30. Furthermore, since the extension pipe 33 is provided under the lower header 34, the extension pipe 33 does not obstruct the path of drainage of the defrost water, and it is therefore possible to prevent deterioration of the drainage.

Figure 8:
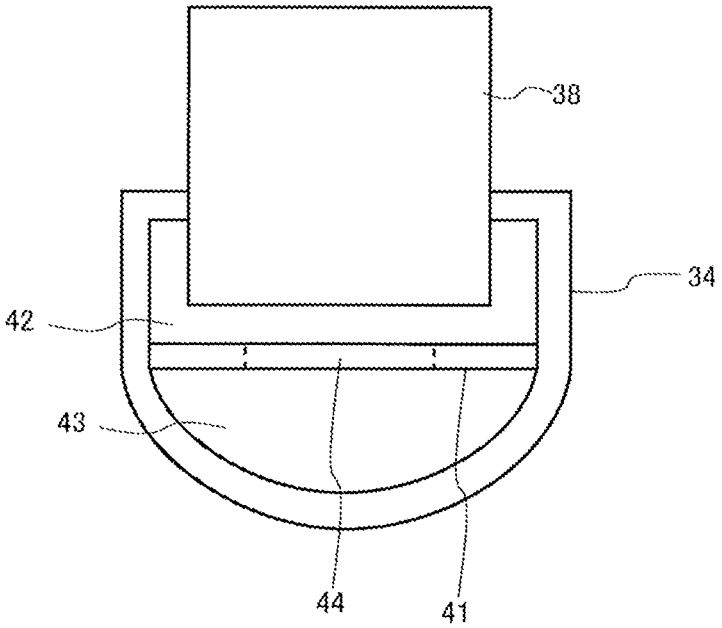
FIG. 8 is a cross-sectional view of a modification of the heat exchanger that is taken along line A-A in FIG. 6.

FIG. 8 is a cross-sectional view of a modification of the heat exchanger 30 that is taken along line A-A in FIG. 6.

In Embodiment 3, the extension pipe 33 is provided separate from the lower header 34; however, the extension pipe 33 may be formed integrally with the lower header 34. In such a case, in the modification, a second partition plate 41 that divides the inside of the lower header 34 in the vertical direction is provided inside the lower header 34 as illustrated in FIG. 8. Thus, the lower header 34 has an upper first flow passage 42 and a lower second flow passage 43. Moreover, an upper portion of the lower header 34 is connected to the liquid pipe 36, and the first flow passage 42 communicates with the liquid pipe 36. Furthermore, a lower portion of the lower header 34 is connected to the gas pipe 37, and the second flow passage 43 communicates with the gas pipe 37. That is, a portion of the lower header 34 that forms the second flow passage 43 corresponds to the extension pipe 33 of Embodiment 3, and a portion of the lower header 34 that forms the second flow passage 43 corresponds to the lower header 34 of Embodiment 3.

In such a manner, in the heat exchanger 30 according to the modification of Embodiment 3, the second flow passage 43 of the lower header 34 is formed in parallel with the first flow passage 42 of the lower header 34, and the second flow passage 43 is formed adjacent to the first flow passage 42, with the second partition plate 41 interposed between the second flow passage 43 and the first flow passage 42. Therefore, when high-temperature and high-pressure gas refrigerant flows through the second flow passage 43 in the defrosting operation, heat can be transferred from the second flow passage 43 of the lower header 34 to the first flow passage 42 of the lower header 34 via the second partition plate 41. Then, the heat transferred to the first flow passage 42 of the lower header 34 is further transferred to defrost water in the vicinity of the lower header 34, thus raising the temperature of the defrost water. Therefore, even when the heating operation is resumed after the defrosting operation ends, it is possible to reduce the probability that the defrost water in the vicinity of the lower header 34 will re-freeze. Thus, it is also possible to reduce deterioration of the heating performance and damage to the heat exchanger 30. Furthermore, since the second flow passage 43 of the lower header 34 is provided under the first flow passage 42 of the lower header 34, the second flow passage 43 does not obstruct the path of drainage of the defrost water, and it is therefore possible to prevent deterioration of the drainage.

As described above, the heat exchanger 30 according to Embodiment 3 includes an extension pipe 33 through which the refrigerant flows out when the heat exchanger 30 operates as an evaporator and through which the refrigerant flows in when the heat exchanger 30 operates as a condenser. Moreover, the extension pipe 33 is provided to extend in the longitudinal direction of the lower header 34 and is at least partly in contact with the lower header 34.

In the heat exchanger 30 according to Embodiment 3, since the extension pipe 33 is at least partly in contact with the lower header 34, when high-temperature and high-pressure gas refrigerant flows through the extension pipe 33 in the defrosting operation, heat can be transferred from the extension pipe 33 to the lower header 34. Then, the heat transferred to the lower header 34 is further transferred to defrost water in the vicinity of the lower header 34, thereby raising the temperature of the defrost water. Therefore, even when the heating operation is resumed after the defrosting operation ends, it is possible to reduce the probability with which the defrost water in the vicinity of the lower header 34 will re-freeze. As a result, it is also possible to reduce deterioration of the heating performance and damage to the heat exchanger 30.

The outdoor unit 10 according to Embodiment 3 includes the above heat exchanger 30. The outdoor unit 10 according to Embodiment 3 can obtain similar advantages to those of the heat exchanger 30.

The air-conditioning apparatus 100 according to Embodiment 3 includes the above outdoor unit 10. The air-conditioning apparatus 100 according to Embodiment 3 can obtain similar advantages to those of the outdoor unit 10.

Embodiment 4

Regarding Embodiment 4, components that are the same as or equivalent to those in Embodiment 2 will be denoted by the same reference signs, and configurations, etc., that are the same as those in Embodiment 2 and have already been described regarding Embodiment 2 will not be re-described.

Figure 9:
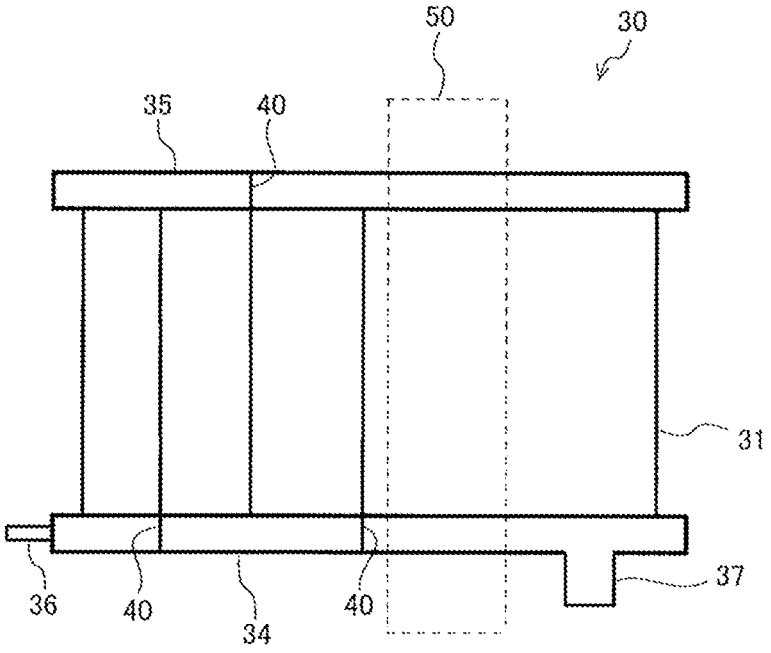
FIG. 9 is a front view schematically illustrating a bending region of a heat exchanger according to Embodiment 4.
Figure 10:
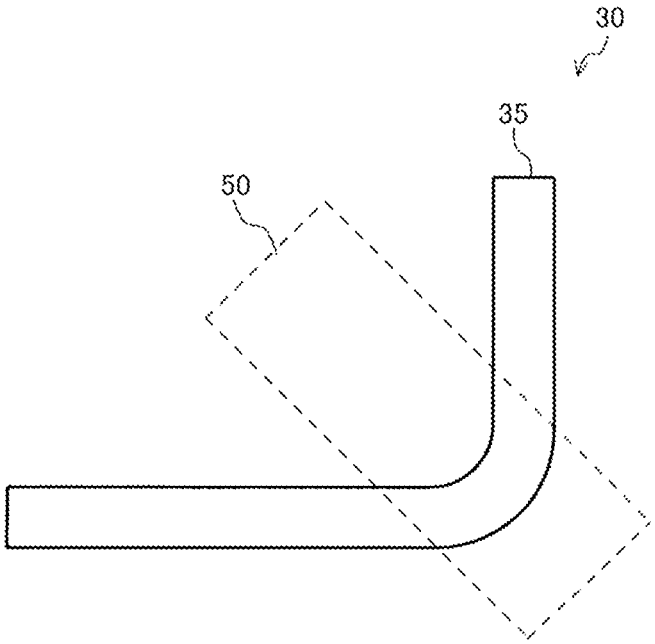
FIG. 10 is a plan view schematically illustrating the bending region of the heat exchanger according to Embodiment 4.

FIG. 9 is a front view schematically illustrating a bending region 50 of a heat exchanger 30 according to Embodiment 4. FIG. 10 is a plan view schematically illustrating the bending region 50 of the heat exchanger 30 according to Embodiment 4.

The heat exchanger 30 may be subjected to bending, for example, in order to improve the heat exchange performance by densely mounting the heat exchanger 30 in the outdoor unit 10 and to make the outdoor unit 10 smaller. In that case, the bending is performed on the inside of the bending region 50 as illustrated in FIGS. 9 and 10. Also, in this case, in the case where the partition plate 40 is provided in the bending region 50, the partition plate 40 is deformed when the heat exchanger 30 is subjected to the bending, thus deteriorating the heat exchange performance. In view of this point, in Embodiment 4, the partition plate 40 is not provided in the bending region 50, but is provided outside the bending region 50. In such a manner, since the partition plate 40 is provided outside the bending region 50, the partition plate 40 is not deformed even when the heat exchanger 30 is subjected to the bending. It is therefore possible to reduce deterioration of the heat exchange performance while improving the heat exchange performance and reducing the size of the outdoor unit 10.

As described above, in the heat exchanger 30 according to Embodiment 4, the upper header 35 and the lower header 34 have a bending region 50 where the heat exchanger 30 is subjected to the bending, and the partition plate 40 is provided in a region other than the bending region 50.

In the heat exchanger 30 according to Embodiment 4, the partition plate 40 is provided outside the bending region 50, whereby the partition plate 40 is not deformed even when the heat exchanger 30 is subjected to the bending. It is therefore possible to reduce the deterioration of the heat exchange performance while improving the heat exchange performance and reducing the size of the outdoor unit 10.

Furthermore, the outdoor unit 10 according to Embodiment 4 includes the above heat exchanger 30. The outdoor unit 10 according to Embodiment 4 can obtain similar advantages to those of the heat exchanger 30.

Furthermore, the air-conditioning apparatus 100 according to Embodiment 4 includes the above outdoor unit 10. The air-conditioning apparatus 100 according to Embodiment 4 can obtain similar advantages to those of the outdoor unit 10.

Embodiment 5

Regarding Embodiment 5, components that are the same as or equivalent to those in Embodiment 2 will be denoted by the same reference signs, and configurations, etc., that are the same as those in Embodiment 2 and have already been described regarding Embodiment 2 will not be re-described.

Figure 11:
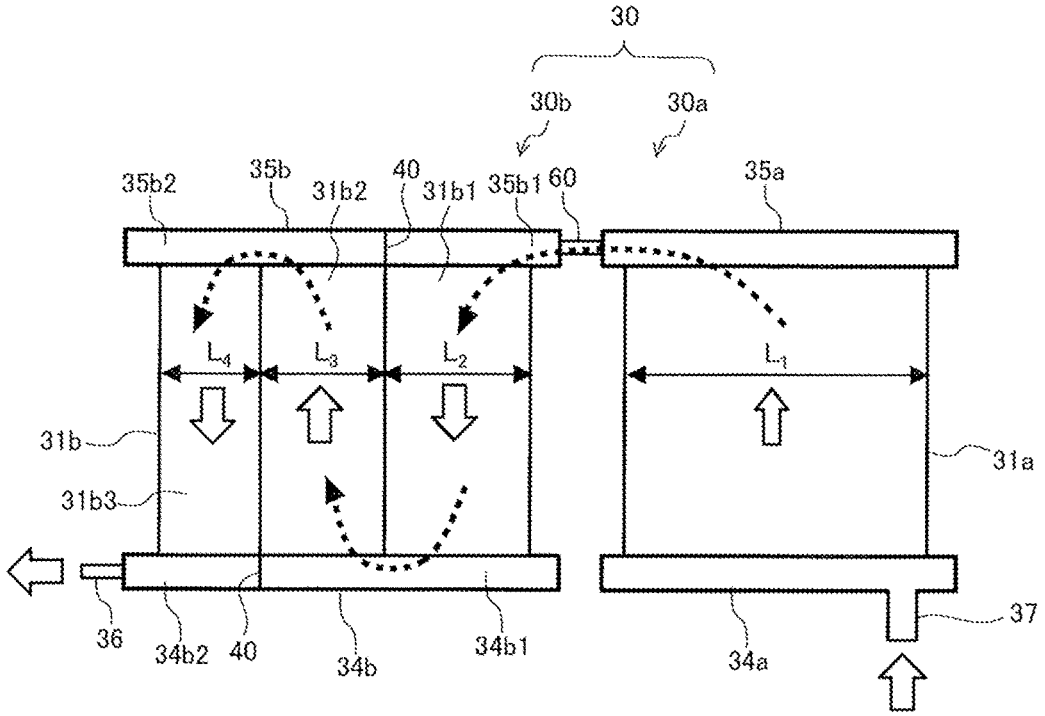
FIG. 11 is a front view schematically illustrating the defrosting-operation refrigerant flow at a heat exchanger according to Embodiment 5.

FIG. 11 is a front view schematically illustrating the defrosting-operation refrigerant flow at a heat exchanger 30 according to Embodiment 5. In FIG. 11, outlined arrows and dashed arrows all indicate the flow of refrigerant.

As illustrated in FIG. 11, the heat exchanger 30 according to Embodiment 5 has a plurality of heat exchange units. Specifically, the heat exchanger 30 includes a first heat exchange unit 30*a* and a second heat exchange unit 30*b*. The first heat exchange unit 30*a* includes a first heat exchange body 31*a*, a first lower header 34*a*, and a first upper header 35*a*. The first heat exchange body 31*a* includes a plurality of flat tubes 38 and a plurality of fins 39. The first lower header 34*a* is provided at a lower end of the first heat exchange body 31*a*. The first upper header 35*a* is provided at an upper end of the first heat exchange body 31*a*. Furthermore, the second heat exchange unit 30*b* includes a second heat exchange body 31*b*, a second lower header 34*b*, and a second upper header 35*b*. The second heat exchange body 31*b* includes a plurality of flat tubes 38 and a plurality of fins 39. The second lower header 34*b* is provided at a lower end of the second heat exchange body 31*b*. The second upper header 35*b* is provided at an upper end of the second heat exchange body 31*b*.

The first lower header 34*a* is connected to the refrigerant circuit of the air-conditioning apparatus 100 by the gas pipe 37. The first lower header 34*a* causes, in the cooling operation, high-temperature and high-pressure gas refrigerant from the compressor 11 to flow into the heat exchanger 30, and causes, in the heating operation, low-temperature and low-pressure gas refrigerant subjected to heat exchange at the heat exchanger 30 to flow out therefrom to the refrigerant circuit.

The second lower header 34*b* is connected to the refrigerant circuit of the air-conditioning apparatus 100 by the liquid pipe 36. The second lower header 34*b* causes, in the heating operation, low-temperature and low-pressure two-phase refrigerant to flow into the heat exchanger 30, and causes, in the cooling operation, low-temperature and high-pressure liquid refrigerant subjected to heat exchange at the heat exchanger 30 to flow out therefrom to the refrigerant circuit.

Furthermore, the first upper header 35*a* and the second upper header 35*b* are connected to each other by a connecting pipe 60 to communicate with each other. Instead of the first upper header 35*a* and the second upper header 35*b*, the first lower header 34*a* and the second lower header 34*b* may be connected to each other by the connecting pipe 60 to communicate with each other. In this case, in Embodiment 5, the gas pipe 37 is connected to the first upper header 35*a*, and the liquid pipe 36 is connected to the second lower header 34*b*.

Furthermore, in the second heat exchange unit 30*b*, partition plates 40 are provided. To be more specific, in the second lower header 34*b* and the second upper header 35*b*, respective partition plates 40 are provided. That is, the total number of partition plates 40 is two. The second heat exchange body 31*b* is partitioned by the partition plates 40 into three regions, namely a first region 31*b*1, a second region 31*b*2, and a third region 31*b*3. However, the number of partition plates 40 is not limited to 2, but may be 1 or may be larger than or equal to 3. It should be noted that in the first heat exchange unit 30*a*, no partition plate 40 is provided.

Moreover, as illustrated in FIG. 11, in the first and third regions 31*b*1 and 31*b*3 of the second heat exchange body 31*b*, the refrigerant flows upward, that is, the flow of the refrigerant is the upward flow, and in the second region 31*b*2 of the second heat exchange body 31*b*, the refrigerant flows downward, that is, the flow of the refrigerant is the downward flow. Furthermore, in the first heat exchange body 31*a*, the refrigerant flows upward. Therefore, each of the regions of the heat exchange body 31 is provided such that in the region, the refrigerant flows in the opposite direction to the flow direction of the refrigerant in one of the regions that is adjacent to the above region. It should be noted that in the defrosting operation, as indicated by arrows in FIG. 11, the refrigerant flows through components and regions in the following order: the gas pipe 37, the first lower header 34*a*, the first heat exchange body 31*a*, the first upper header 35*a*, the connecting pipe 60, a first region 35*b*1 of the second upper header 35*b*, the first region 31*b*1 of the second heat exchange body 31*b*, a first flow passage 34*b*1 of the second lower header 34*b*, the second region 31*b*2 of the second heat exchange body 31*b*, a second region 35*b*2 of the second upper header 35*b*, the third region 31*b*3 of the second heat exchange body 31*b*, a second flow passage 34*b*2 of the second lower header 34*b*, and then the liquid pipe 36.

Furthermore, L1>L2>L3>L4, where L1, L2, L3, and L4 are the lengths of the first heat exchange body 31*a* and the first region 31*b*1, second region 31*b*2 and third regions 31*b*3 of the second heat exchange body 31*b* in the horizontal direction, respectively. Therefore, in the first heat exchange body 31*a*, the number of flat tubes 38 provided is the largest, and the first heat exchange body 31*a* has the largest flow passage cross-sectional area; and in the third region 31*b*3 of the second heat exchange body 31*b*, the number of flat tubes 38 provided is the smallest, and the third region 31*b* has the smallest flow passage cross-sectional area. That is, the above regions, that is, the first heat exchange body 31*a* and the regions of the second heat exchange body 31*b*, are provided such that the most downstream the region in the defrosting-operation refrigerant flow, the smaller the flow passage cross-sectional area of the region.

In such a manner, in the defrosting-operation refrigerant flow, in a region located downstream, the flow passage cross-sectional area is made smaller than that of a region located upstream, on the premise that in these regions, the refrigerant flows at the same flow rate, whereby the flow velocity of the refrigerant in the region located downstream can be higher than that in the region located upstream. It is therefore possible to reduce the probability with which backflow of the refrigerant will occur, even in the case where the more downstream the refrigerant, the higher the ratio of the liquid phase of the refrigerant, and is also possible to reduce deterioration of the defrosting performance which would be caused by the backflow of the refrigerant.

Furthermore, the heat exchanger 30 is formed to include the first heat exchange unit 30*a* and the second heat exchange unit 30*b*, and the first heat exchange unit 30*a* and the second heat exchange unit 30*b* are connected by the connecting pipe 60, whereby the heat exchanger 30 can be easily subjected to the bending. Furthermore, since the first heat exchange unit 30*a* and the second heat exchange unit 30*b* are connected to each other, it suffices that the gas pipe 37 is connected only to a header of either the first heat exchange unit 30*a* or the second heat exchange unit 30*b*. It is therefore possible to reduce the space for pipe arrangement, and improve the heat exchange performance by densely mounting the heat exchanger 30 in the outdoor unit 10.

Although it is described above that the heat exchanger 30 according to Embodiment 5 includes two heat exchange units, it is not limiting. The heat exchanger 30 may include three or more heat exchange units. In the case where the heat exchanger 30 includes three or more heat exchange units, the upper headers or lower headers of adjacent ones of the heat exchange units are connected to each other by the connecting pipe 60, and the adjacent heat exchange units communicate with each other through the upper headers or the lower headers.

As described above, in the heat exchanger 30 according to Embodiment 5, the heat exchange body 31 includes a first heat exchange body 31*a* and a second heat exchange body 31*b*. Furthermore, the upper header 35 includes a first upper header 35*a* provided at an upper end of the first heat exchange body 31*a* and a second upper header 35*b* provided at an upper end of the second heat exchange body 31*b*. Furthermore, the lower header 34 includes a first lower header 34*a* provided at a lower end of the first heat exchange body 31*a* and a second lower header 34*b* provided at a lower end of the second heat exchange body 31*b*. In addition, the first upper header 35*a* and the second upper header 35*b* or the first lower header 34*a* and the second lower header 34*b* are connected to each other by the connecting pipe 60 to communicate with each other.

In the heat exchanger 30 according to Embodiment 5, since the first upper header 35*a* and the second upper header 35*b* or the first lower header 34*a* and the second lower header 34*b* are connected to each other by the connecting pipe 60 to communicate with each other, the heat exchanger 30 can be easily subjected to the bending. Furthermore, since the first heat exchange unit 30*a* and the second heat exchange unit 30*b* are connected to each other, it suffices that the gas pipe 37 is connected only to a header of either the first heat exchange unit 30*a* or the second heat exchange unit 30*b*. It is therefore possible to reduce the space for pipe arrangement, and improve the heat exchange performance by densely mounting the heat exchanger 30 in the outdoor unit 10.

The outdoor unit 10 according to Embodiment 5 includes the above heat exchanger 30. The outdoor unit 10 according to Embodiment 5 can obtain similar advantages to those of the heat exchanger 30.

The air-conditioning apparatus 100 according to Embodiment 5 includes the above outdoor unit 10. The air-conditioning apparatus 100 according to Embodiment 5 can obtain similar advantages to those of the outdoor unit 10.

Embodiment 6

Regarding Embodiment 6, components that are the same as or equivalent to those in Embodiment 5 will be denoted by the same reference signs, and configurations, etc., that are the same as those in Embodiment 5 and have already been described regarding Embodiment 2 will not be re-described.

Figure 12:
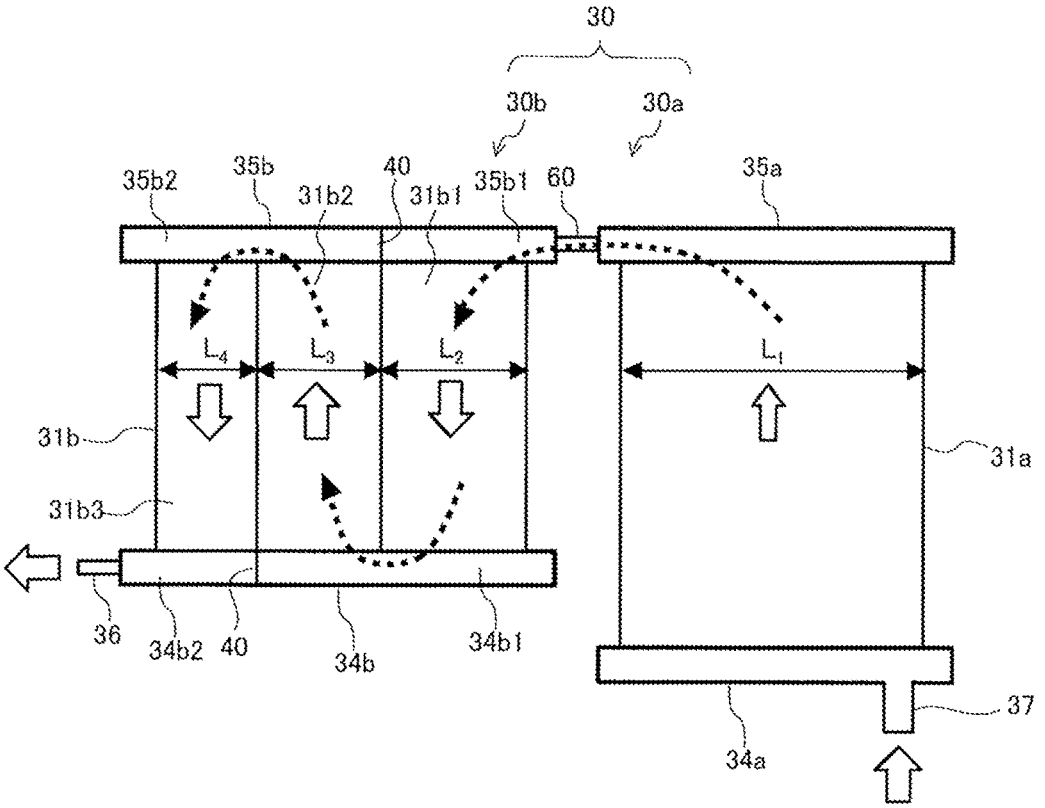
FIG. 12 is a front view schematically illustrating the defrosting-operation refrigerant flow at a heat exchanger according to Embodiment 6.

FIG. 12 is a front view schematically illustrating the defrosting-operation refrigerant flow at a heat exchanger 30 according to Embodiment 6.

In the heat exchanger 30 according to Embodiment 6, as illustrated in FIG. 12, the first heat exchange body 31*a* and the second heat exchange body 31*b* have different lengths in the vertical direction, and the first heat exchange body 31*a* is longer than the second heat exchange body 31*b*. Furthermore, the first heat exchange body 31*a* and the second heat exchange body 31*b* are provided at the same level, or the first heat exchange body 31*a* is provided at a higher level than the second heat exchange body 31*b*.

Moreover, the first upper header 35*a* and the second upper header 35*b* are connected to each other by a connecting pipe 60 to communicate with each other.

Thus, in the defrosting-operation refrigerant flow, the refrigerant flows downward or in the horizontal direction in the connecting pipe 60. It is therefore possible to reduce the probability with which backflow will occur that would do if the refrigerant flows upward in the connecting pipe 60, and also to reduce deterioration of the defrosting performance which would be caused by backflow of the refrigerant.

The heat exchanger 30 according to Embodiment 6 includes two heat exchange units; however, the number of heat exchange units in the heat exchanger 30 is not limited to two. The heat exchanger 30 may include three or more heat exchange units. In the case where the heat exchanger 30 includes three or more heat exchange units, the upper headers or lower headers of adjacent ones of the heat exchange units are connected to each other by a connecting pipe 60, and the adjacent heat exchange units communicate with each other through the upper headers or the lower headers; and also in the defrosting-operation refrigerant flow, the refrigerant flows downward or in the horizontal direction through each connecting pipe 60.

As described above, in the heat exchanger 30 according to Embodiment 6, the first heat exchange body 31*a* and the second heat exchange body 31*b* have different lengths, and when the heat exchanger 30 operates as a condenser, the refrigerant flows downward or in the horizontal direction through the connecting pipe 60.

In the heat exchanger 30 according to Embodiment 6, when the heat exchanger 30 operates as a condenser, in the connecting pipe 60, the refrigerant flows downward or horizontally. It is therefore possible to reduce the probability with which backflow will occur that would do if the refrigerant flows upward in the connecting pipe 60, and also to reduce deterioration of the defrosting performance which would be caused by backflow of the refrigerant.

Furthermore, the outdoor unit 10 according to Embodiment 6 includes the above heat exchanger 30. The outdoor unit 10 according to Embodiment 6 can obtain similar advantages to those of the heat exchanger 30.

Furthermore, the air-conditioning apparatus 100 according to Embodiment 6 includes the above outdoor unit 10. The air-conditioning apparatus 100 according to Embodiment 6 can obtain similar advantages to those of the outdoor unit 10.

Embodiment 7

Regarding Embodiment 7, components that are the same as or equivalent to those in any of Embodiments 1 to 6 will be denoted by the same reference signs, and configurations, etc., that are the same as those in any of Embodiments 1 to 6 and have already been described regarding Embodiments 1 to 6 will not be re-described.

Figure 13:
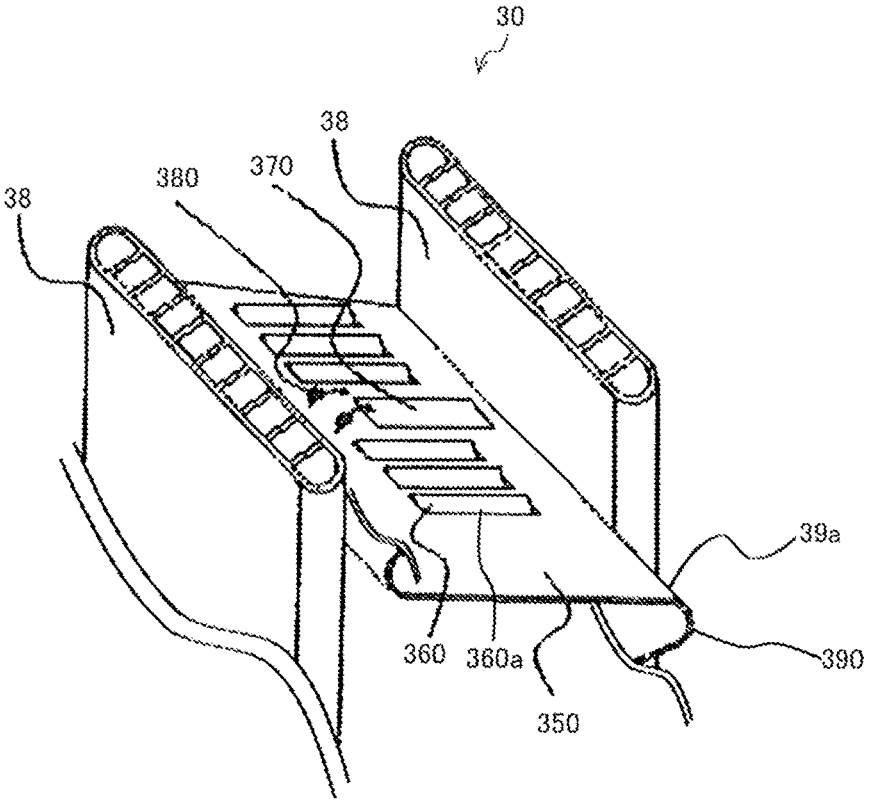
FIG. 13 is a perspective view schematically illustrating related components of a heat exchanger according to Embodiment 7.

FIG. 13 is a perspective view schematically illustrating related components of a heat exchanger 30 according to Embodiment 7.

As illustrated in FIG. 13, the heat exchanger 30 according to Embodiment 7 includes a plurality of flat tubes 38 and a plurality of corrugated fins 39*a*. Each of the corrugated fins 39*a* is formed in a corrugated shape and has a plurality of apices 390, and each of the apices 390 is in surface contact with a flat surface of an associated adjacent one of the flat tubes 38, except for an end of the apex 390 that projects upstream in the flow direction of air (hereinafter referred to as "first direction") in the space between associated two flat tubes 38. It should be noted that the corrugated fin 39*a* is joined to the flat tubes 38 by brazing. The corrugated fin 39*a* is made, for example, of a plate material of an aluminum alloy. Moreover, a brazing filler metal layer is stacked on a surface of the plate material, and the brazing filler metal layer is formed, for example, of a brazing filler metal containing Al-Si based aluminum. Furthermore, the plate material has a plate thickness of approximately 50 to 200 μm.

The corrugated fin 39*a* has fin surfaces 350 each of which is located between associated ones of the apices 390 that are adjacent in a direction in which the flat tubes 38 are arranged (which will be hereinafter referred to as "second direction") of the flat tubes 38, and the fin surfaces 350 are arranged in a height direction. Furthermore, each of the fin surfaces 350 has louvers 360 and a drainage slit 370. The louvers 360 are arranged in the first direction at the fin surface 350. That is, the louvers 360 are arranged in the flow direction of air. The louvers 360 are formed by cutting and raising parts of the fin surface 350. Also, by cutting up parts of the fin surface 350, slits 360*a* are formed in positions associated with the louvers 360 to allow air to pass through the slits 360*a*. The louvers 360 serve to guide air that passes through the slits 360*a*.

The fin surfaces 350 have drainage slits 370 each of which is formed close to a central portion of an associated one of the fin surfaces 350 in the first direction, and each of which allows water on the fin surface 350 to be let out. The drainage slits 370 each have a rectangle extending in the second direction. As described later, the drainage slits 370 of ones of the fin surfaces 350 that are adjacent to each other at least in the height direction are located such that central positions of the above drainage slits 370 in the second direction are displaced from each other, and the positions of ends of the above drainage slits 370 are different from each other in the second direction.

When the heat exchanger 30 operates as an evaporator, the temperatures of the surfaces of the flat tubes 38 and the corrugated fins 39*a* are lower than that of air that passes through the heat exchanger 30. Therefore, moisture in the air condenses on the surfaces of the flat tubes 38 and the corrugated fins 39*a*, thereby generating condensed water 380.

Condensed water 380 generated on each of the fin surfaces 350 of each of the corrugated fins 39*a* flows through an associated drainage slit 370 and falls onto an associated lower fin surface 350. In this case, in a region where the amount of the condensed water 380 is large, the condensed water 380 easily flows over the fin surface 350, and thus also easily falls onto the lower fin surface 350 through the drainage slit 370. On the other hand, in a region where the amount of the condensed water 380 is small, the condensed water 380 is easily retained and stay on the above fin surface 350, and does not easily flow over the fin surface 350.

Figure 14:
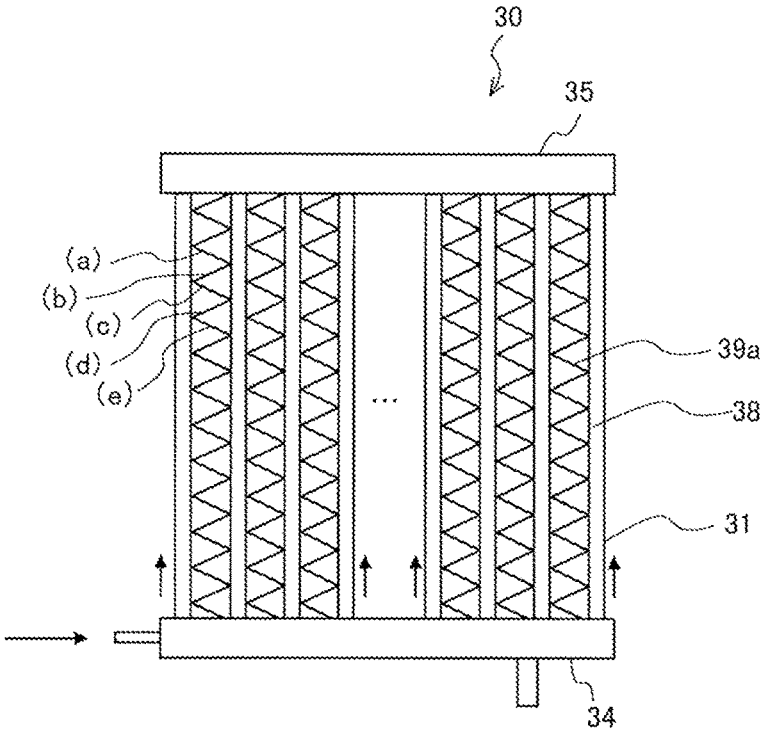
FIG. 14 is a front view schematically illustrating the heat exchanger according to Embodiment 7.
Figure 15:
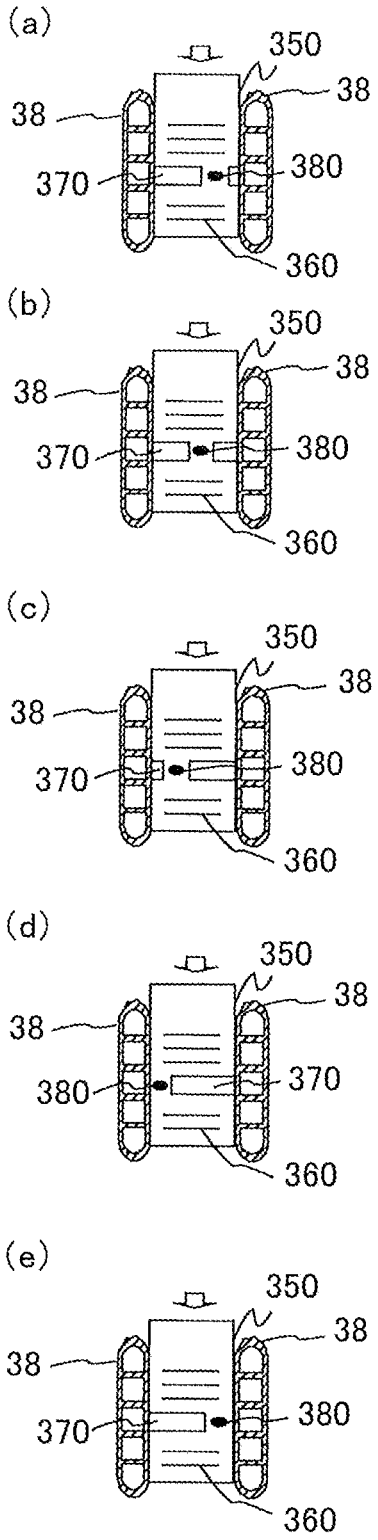
FIG. 15 is a diagram for explanation of positional relationships between drainage slits in fin surfaces of a corrugated fin as illustrated in FIG. 14.

FIG. 14 is a front view schematically illustrating the heat exchanger 30 according to Embodiment 7. FIG. 15 is a diagram for explanation of positional relationships between drainage slits 370 in fin surfaces 350 of corrugated fins 39*a* as illustrated in FIG. 14. It should be noted that (a) to (e) in FIG. 15 illustrate fin surfaces 350 located at positions (a) to (e) in FIG. 14, respectively.

As described above, as illustrated in FIGS. 14 and 15, the drainage slits 370 of ones of the fin surfaces 350 that are adjacent to each other at least in the height direction are located such that the central positions of the above drainage slits 370 in the second direction are displaced from each other, and the positions of the ends of the above drainage slits 370 are different from each other in the second direction. In the heat exchanger 30 according to Embodiment 7, although it is not limited, it is assumed that the drainage slits 370 of the fin surfaces 350 of each of the corrugated fins 39*a* are provided such that drainage slits 370 whose central positions in the second direction are the same as each other are periodically located in the corrugated fin 39*a*.

Therefore, condensed water 380 that has fallen, from an end of a drainage slit 370 in a fin surface 350 in the second direction, falls onto a subsequent lower fin surface 350. Then, the condensed water 380 that has fallen onto the subsequent lower fin surface 350 joins condensed water 380 retained on the subsequent lower fin surface 350. Thus, the amount of resultant condensed water 380 obtained by the above joining is increased, and this condensed water 380 easily falls through the drainage slit 370 of the above subsequent lower fin surface 350, onto a further subsequent lower fin surface 350. Therefore, the amount of condensed water 380 retained on the fin surface 350 is decreased. Accordingly, it is possible to efficiently drain water and reduce the deterioration of the defrosting operation FIG. 16 is a diagram for explanation of the flow of condensed water 380 on surfaces of a corrugated fin 39*a* in the heat exchanger 30 according to Embodiment 7.

An apex 390 of the corrugated fin 39*a* that is joined to a flat tube 38 is formed by bending the corrugated fin 39*a*, and at the apex 390, the distance between fin surfaces 350 is short. Thus, condensed water 380 at the apex 390 is easily retained and stay at the apex 390 by surface tension.

Figure 16:
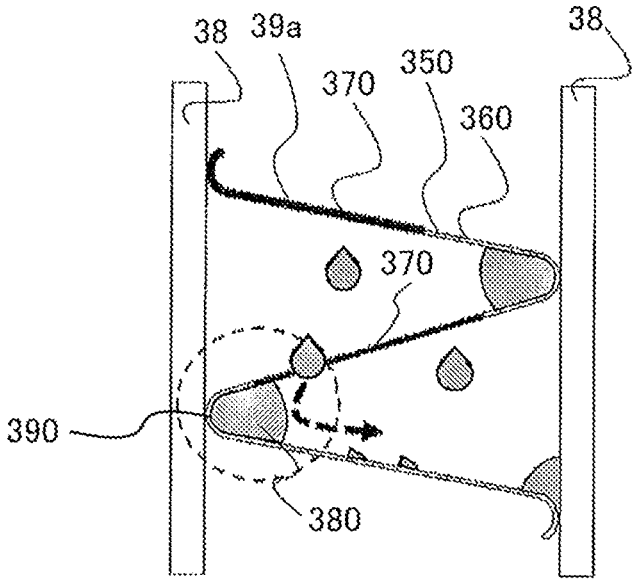
FIG. 16 is a diagram for explanation of the flow of condensed water on surfaces of a corrugated fin of the heat exchanger according to Embodiment 7.

In the heat exchanger 30 according to Embodiment 7, for example, as illustrated in (d) and (e) in FIG. 15 and FIG. 16, at a fin surface 350, an end of a drainage slit 370 in the second direction can be provided at or near the apex 390. At the fin surface 350, in the case where the end of the drainage slit 370 in the second direction is located at or near the apex 390, condensed water 380 at the apex 390 and condensed water 380 that falls from an upper fin surface 350 can join each other, whereby the effect of the surface tension is eliminated, and the condensed water 380 at the apex 390 thus flows out from the apex 390 and falls onto a lower fin surface 350. Furthermore, drainage slits 370 are provided at both ends of an associated one of respective fin surfaces 350 in the second direction as illustrated in (a) to (c) in FIG. 15, whereby it is possible to further efficiently drain water.

As described above, in the heat exchanger 30 according to Embodiment 7, the fin surfaces 350 have respective drainage slits 370 for drainage of water, and positions of ends of the drainage slits 370 formed in ones of the fin surfaces 350 that are adjacent to each other in the height direction are different from each other in an arrangement direction of the flat tubes 38 in which they are arranged.

In the heat exchanger 30 according to Embodiment 7, condensed water 380 having fallen from an end of a drainage slit 370 in each fin surface 350 in the arrangement direction of the flat tubes 38 falls onto a subsequent lower fin surface 350. Then, the condensed water 380 that has fallen onto the subsequent lower fin surface 350 joins condensed water 380 retained on the lower fin surface 350, whereby those condensed water 380 is combined, the amount of the combined condensed water 380 increases, and the combined condensed water 380 easily flows and fall onto a further lower in surface 350 through an associated drainage slit 370. Thus, the amount of the above condensed water 380 retained on the fin surface 350 decreases. It is therefore possible to efficiently drain water, and reduce the deterioration of the defrosting operation.

REFERENCE SIGNS LIST

10: outdoor unit, 11: compressor, 12: flow switching device, 13: fan, 20: indoor unit, 21: expansion device, 22: indoor heat exchanger, 23: indoor fan, 30: heat exchanger, 30*a*: first heat exchange unit, 30*b*: second heat exchange unit, 31: heat exchange body, 31*a*: first heat exchange body, 31*b*: second heat exchange body, 31*b*1: first region, 31*b*2: second region, 31*b*3: third region, 33: extension pipe, 34: lower header, 34*a*: first lower header, 34*b*: second lower header, 34*b*1: first flow passage, 34*b*2: second flow passage, 35: upper header, 35*a*: first upper header, 35*b*: second upper header, 35*b*1: first region, 35*b*2: second region, 36: liquid pipe, 37: gas pipe, 38: flat tube, 39: fin, 39*a*: corrugated fin, 40: partition plate, 41: second partition plate, 42: first flow passage, 43: second flow passage, 44: opening port, 50: bending region, 60: connecting pipe, 100: air-conditioning apparatus, 311: first region, 312: second region, 313: third region, 314: fourth region, 341: first portion, 342: second portion, 350: fin surface, 360: louver, 360*a*: slit, 370 drainage slit, 380: condensed water, 390: apex

The invention claimed is:

1. A heat exchanger comprising:

a heat exchange body having a plurality of flat tubes arranged and spaced from each other;

an upper header provided at an upper end of the heat exchange body;

a lower header provided at a lower end of the heat exchange body, the lower end of the heat exchange body being located below the upper end of the heat exchange body; and a partition plate provided in at least one of the upper header and the lower header to partition the heat exchange body into a plurality of regions, wherein the upper header and the lower header each have a bend in a bending area, wherein the partition plate is provided such that in each of the regions, refrigerant flows in the opposite direction to the flow direction of the refrigerant in an adjacent one of the regions, and is provided such that regarding the regions, the more downstream a region is relative to a flow of the refrigerant when the heat exchanger operates as a condenser, the smaller is a flow passage cross-sectional area of the region, and wherein the partition plate is provided in an area other than the bending area.

2. The heat exchanger of claim 1, wherein the heat exchanger is configured such that when the heat exchanger operates as a condenser, in one of the regions that is located most downstream relative to the flow of the refrigerant, the refrigerant flows downward.

3. The heat exchanger of claim 1, further comprising an extension pipe through which the refrigerant flows out when the heat exchanger operates as an evaporator and through which the refrigerant flows in when the heat exchanger operates as a condenser, wherein the extension pipe is provided in a longitudinal direction of the lower header and is at least partly in contact with the lower header.

4. The heat exchanger of claim 1, wherein the heat exchange body includes a first heat exchange body and a second heat exchange body, the upper header includes a first upper header provided at an upper end of the first heat exchange body and a second upper header provided at an upper end of the second heat exchange body, the lower header includes a first lower header provided at a lower end of the first heat exchange body and a second lower header provided at a lower end of the second heat exchange body, the first upper header and the second upper header or the first lower header and the second lower header are connected to each other by a connecting pipe to communicate with each other, the lower end of the first heat exchange body is located below the upper end of the first heat exchange body, and the lower end of the second heat exchange body is located below the upper end of the second heat exchange body.

5. The heat exchanger of claim 4, wherein the first heat exchange body and the second heat exchange body have different lengths, and when the heat exchanger operates as a condenser, in the connecting pipe, the refrigerant flows downward or horizontally.

6. The heat exchanger of claim 1, further comprising a plurality of corrugated fins each provided between associated adjacent ones of the flat tubes, wherein each of the corrugated fins has a corrugated shape, and includes a plurality of apices joined to the flat tubes and a plurality of fin surfaces provided between the apices and disposed in the height direction of the corrugated fins.

7. The heat exchanger of claim 6, wherein the fin surfaces include respective drainage slits through which water is drained, and the positions of the ends of the drainage slits formed in ones of the fin surfaces that are adjacent to each other in the height direction are offset from each other in a direction that is perpendicular to the height direction.

8. An outdoor unit comprising the heat exchanger of claim 1.

9. An air-conditioning apparatus comprising the outdoor unit of claim 8.

10. A heat exchanger comprising:

a heat exchange body having a plurality of flat tubes arranged and spaced from each other;

an upper header provided at an upper end of the heat exchange body;

a lower header provided at a lower end of the heat exchange body, the lower end of the heat exchange body being located below the upper end of the heat exchange body; and a partition plate provided in at least one of the upper header and the lower header to partition the heat exchange body into a plurality of regions, wherein the partition plate is provided such that in each of the regions, refrigerant flows in the opposite direction to the flow direction of the refrigerant in an adjacent one of the regions, and is provided such that regarding the regions, the more downstream a region is relative to the flow of the refrigerant when the heat exchanger operates as a condenser, the smaller is a flow passage cross-sectional area of the region, and wherein the heat exchanger is configured such that the refrigerant flows upward in a region located most downstream relative to the flow of the refrigerant, when the heat exchanger operates as a condenser, and the flow of the refrigerant in the region located most downstream relative to the flow of the refrigerant has a flooding constant C greater than 1.

* * * * *